US010194260B2

(12) United States Patent
Iseki

(10) Patent No.: US 10,194,260 B2
(45) Date of Patent: Jan. 29, 2019

(54) SOUND VOLUME CONTROL DEVICE, SOUND VOLUME CONTROL METHOD AND SOUND VOLUME CONTROL PROGRAM

(71) Applicant: PIONEER CORPORATION, Tokyo (JP)

(72) Inventor: Akihiro Iseki, Saitama (JP)

(73) Assignee: PIONEER CORPORATION, Tokyo (JP)

( * ) Notice: Subject to any disclaimer, the term of this patent is extended or adjusted under 35 U.S.C. 154(b) by 0 days.

(21) Appl. No.: 15/553,682

(22) PCT Filed: Feb. 27, 2015

(86) PCT No.: PCT/JP2015/055919
§ 371 (c)(1),
(2) Date: Aug. 25, 2017

(87) PCT Pub. No.: WO2016/135964
PCT Pub. Date: Sep. 1, 2016

(65) Prior Publication Data

US 2018/0048980 A1 Feb. 15, 2018

(51) Int. Cl.
*H04S 7/00* (2006.01)
*H04R 3/04* (2006.01)
(Continued)

(52) U.S. Cl.
CPC ..... *H04S 7/307* (2013.01); *H04R 3/04* (2013.01); *H04R 3/12* (2013.01); *H04R 5/02* (2013.01);
(Continued)

(58) Field of Classification Search
CPC ..... H04R 2499/13; H04R 5/02; H04S 7/307; H04S 7/302
(Continued)

(56) References Cited

U.S. PATENT DOCUMENTS 4,868,878 A 9/1989 Kunugi et al.
4,980,914 A 12/1990 Kunugi et al.
(Continued)

FOREIGN PATENT DOCUMENTS

JP 60-214192 10/1985
JP 05-90856 4/1993
(Continued)

OTHER PUBLICATIONS

International Search Report, PCT/JP2015/055919, dated Apr. 14, 2015.

*Primary Examiner* — David Ton
(74) *Attorney, Agent, or Firm* — Young & Thompson

(57) ABSTRACT

A sound volume control device is loaded on a vehicle and connected to a pair of speakers arranged left and right sides of two listening positions in a vehicle interior. Based on vehicle information, a first frequency characteristic and a second frequency characteristic, which are respective frequency characteristics at the two listening positions, of sound outputted from at least one of the pair of speakers are derived. Based on such characteristics, a sound signal supplied to at least one of the pair of speakers is controlled. When there is a common peak of the sound common to the first and second frequency characteristic, the sound signal is controlled in at least one of peak frequency bands which are the peak frequency bands corresponding to the common peak. Thereby, the sound signal is controlled such that the peaks appearing on the respective frequency characteristics at two listening positions are corrected.

10 Claims, 10 Drawing Sheets

(51) Int. Cl.
*H04R 5/02* (2006.01)
*H04R 3/12* (2006.01)
*H04R 29/00* (2006.01)

(52) U.S. Cl.
CPC ..... *H04R 29/001* (2013.01); *H04R 29/008* (2013.01); *H04S 7/302* (2013.01); *H04R 2430/03* (2013.01); *H04R 2499/13* (2013.01)

(58) Field of Classification Search
USPC ..... 381/86
See application file for complete search history.

(56) References Cited

U.S. PATENT DOCUMENTS 5,572,443 A * 11/1996 Emoto ..... H03G 5/165 381/101
7,995,774 B2 8/2011 Ise
8,081,776 B2 12/2011 Haulick et al.
9,008,331 B2 4/2015 Aggarwal et al.
2002/0159605 A1* 10/2002 Yoshino ..... H04S 7/301 381/94.1
2005/0265560 A1 12/2005 Haulick et al.
2006/0147057 A1 7/2006 Aggarwal et al.
2009/0154725 A1* 6/2009 Paik ..... H04S 3/002 381/86
2009/0169028 A1 7/2009 Ise
2009/0274309 A1* 11/2009 Pedersen ..... H04S 3/00 381/56
2015/0139443 A1* 5/2015 Okimoto ..... H04S 1/002 381/86
2015/0208169 A1* 7/2015 Tawada ..... H04R 3/04 381/103
2016/0014505 A1* 1/2016 Iseki ..... H04R 1/403 381/86
2016/0219385 A1* 7/2016 Hashimoto ..... H04R 29/001

FOREIGN PATENT DOCUMENTS

JP 07-274282 10/1995
JP 09-65483 3/1997
JP 2000-261900 9/2000
JP 2008-022093 1/2008
JP 4402040 1/2010
JP 2010-111339 5/2010
JP 2011-205692 10/2011
JP 5014111 8/2012
JP 2012-257079 12/2012
JP 2015015550 A * 1/2015

* cited by examiner (B)

(C)

$$Fpeak[Hz] = C(\sqrt{w^2 + 4d^2})^{-1}$$

SOUND VOLUME CONTROL DEVICE, SOUND VOLUME CONTROL METHOD AND SOUND VOLUME CONTROL PROGRAM

TECHNICAL FIELD

The present invention relates to a technique of adjusting sound that a listener listens in a vehicle interior space.

BACKGROUND TECHNIQUE

There are proposed methods of adjusting sound pressure levels of reproduced sound in an acoustic space such as a vehicle interior. For example, Patent Reference 1 discloses a method of cancelling peaks and dips of sound outputted by a plurality of speakers provided in a vehicle interior by using two or more speakers.

Patent Reference 2 discloses a method of automatically determining an equalizing filter characteristic for an indoor communication system of a cabin for a vehicle. Specifically, it is disclosed that a maximum value of magnitude of transfer function is determined to provide attenuation at a frequency band at the center of the maximum value.

Patent Reference 3 discloses a method of designing one or more filters to substantially equalize a frequency response in a frequency range for a listening area.

Patent Reference 4 discloses a method of setting an equalizer by reading out set values in accordance with presence or absence of a person at each passenger position in an interior of a movable body, in an acoustic control device for controlling sound signals outputted in the interior of the movable body.

PRIOR ART REFERENCES

Patent References

Patent Reference 1: Japanese Patent No. 5014111

Patent Reference 2: Japanese Patent Application Laid-open under No. 2011-205692

Patent Reference 3: Japanese Patent No. 4402040

Patent Reference 4: Japanese Patent Application Laid-open under No. 2010-111339

SUMMARY OF THE INVENTION

Problem to be Solved by the Invention

When sound signals are reproduced in a vehicle interior, reflection by doors, windows and seats of the vehicle interior generates peaks and dips in a frequency characteristic of the sound signal listened at each seat. Normally, since there are two seats, i.e., a driver's seat and an assistant driver's seat, at the front part of the vehicle interior, it is desired to correct peaks and dips in the frequency characteristic at both seats.

For example, it is supposed that the sound from a left speaker is too large at a certain frequency band for a person at the assistant driver's seat. In this case, if the sound at the frequency band is decreased, it becomes comfortable for the person at the assistant driver's seat, but the sound at the frequency band becomes inaudible for a person at the driver's seat.

In this case, since Patent Reference 1 performs processing based on surface data in the vehicle interior, it requires enormous measurement data and calculation.

On the other hand, since Patent References 2 to 4 perform a local control for a controlled position, a deviation from a target value becomes large if a head of the listener (i.e., a listening position) shifts from the controlled position. Additionally, when the controlled positions are increased, it requires enormous measurement and calculation.

The above is an example of the problem to be solved by the present invention. It is an object of the present invention to provide a sound volume control device capable of correcting peaks in frequency characteristics at two seats in a vehicle interior at the same time, without requiring complicated calculation.

Means for Solving the Problem

An invention described in claims is a sound volume control device connected to a pair of speakers arranged on left and right sides of two listening positions in a vehicle interior, comprising: an obtaining unit configured to obtain vehicle information; a deriving unit configured to derive a first frequency characteristic and a second frequency characteristic, which are respective frequency characteristics at the two listening positions, of sound outputted from at least one of the pair of speakers based on the vehicle information; and a control unit configured to control a sound signal supplied to said at least one of the pair of speakers based on the first frequency characteristic and the second frequency characteristic, wherein, when there is a common peak of the sound common to the first frequency characteristic and the second frequency characteristic, the control unit controls the sound signal in at least one of peak frequency bands which are the peak frequency bands corresponding to the common peak.

Another invention described in claims is a sound volume control method executed by a sound volume control device connected to a pair of speakers arranged on left and right sides of two listening positions in a vehicle interior, comprising: an obtaining process configured to obtain vehicle information; a deriving process configured to derive a first frequency characteristic and a second frequency characteristic, which are respective frequency characteristics at the two listening positions, of sound outputted from at least one of the pair of speakers based on the vehicle information; and a control process configured to control a sound signal supplied to said at least one of the pair of speakers based on the first frequency characteristic and the second frequency characteristic, wherein, when there is a common peak of the sound common to the first frequency characteristic and the second frequency characteristic, the control process controls the sound signal in at least one of peak frequency bands which are the peak frequency bands corresponding to the common peak.

Still another invention described in claims is a sound volume control program executed by a sound volume control device connected to a pair of speakers arranged on left and right sides of two listening positions in a vehicle interior, the program causing the sound volume control device function as: an obtaining unit configured to obtain vehicle information; a deriving unit configured to derive a first frequency characteristic and a second frequency characteristic, which are respective frequency characteristics at the two listening positions, of sound outputted from at least one of the pair of speakers based on the vehicle information; and a control unit configured to control a sound signal supplied to said at least one of the pair of speakers based on the first frequency characteristic and the second frequency characteristic, wherein, when there is a common peak of the sound common to the first frequency characteristic and the second frequency characteristic, the control unit controls the sound signal in at least one of peak frequency bands which are the peak frequency bands corresponding to the common peak.

DETAILED DESCRIPTION OF THE PREFERRED EMBODIMENTS

Figure 1:
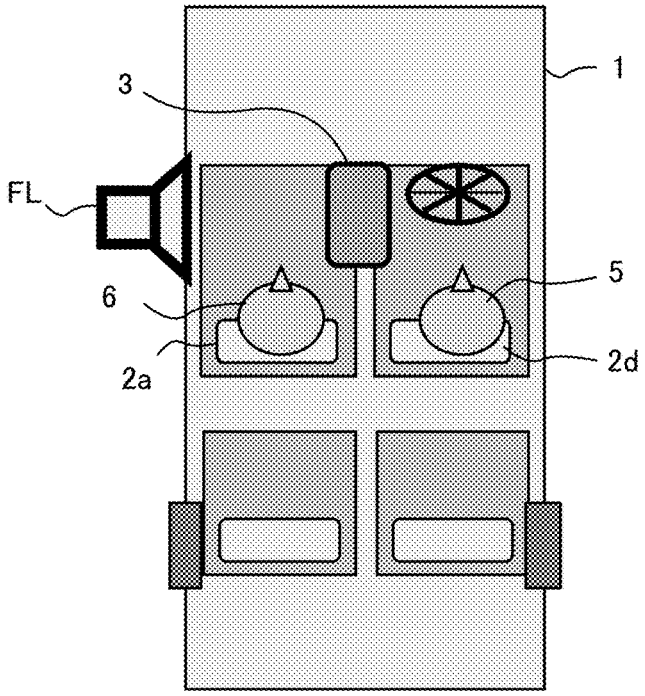
FIG. 1 is a plan view showing an example of a vehicle interior configuration of a general sedan-type vehicle.

According to one aspect of the present invention, there is provided a sound volume control device connected to a pair of speakers arranged on left and right sides of two listening positions in a vehicle interior, comprising: an obtaining unit configured to obtain vehicle information; a deriving unit configured to derive a first frequency characteristic and a second frequency characteristic, which are respective frequency characteristics at the two listening positions, of sound outputted from at least one of the pair of speakers based on the vehicle information; and a control unit configured to control a sound signal supplied to said at least one of the pair of speakers based on the first frequency characteristic and the second frequency characteristic, wherein, when there is a common peak of the sound common to the first frequency characteristic and the second frequency characteristic, the control unit controls the sound signal in at least one of peak frequency bands which are the peak frequency bands corresponding to the common peak.

The above sound volume control device is loaded on a vehicle, and is connected to a pair of speakers arranged on left and right sides of two listening positions in a vehicle interior. Based on the vehicle information, there are derived a first frequency characteristic and a second frequency characteristic, which are respective frequency characteristics at the two listening positions, of sound outputted from at least one of the pair of speakers. Based on those frequency characteristics, a sound signal supplied to said at least one of the pair of speakers is controlled. Specifically, when there is a common peak of the sound common to the first frequency characteristic and the second frequency characteristic, the sound signal is controlled in at least one of peak frequency bands which are the peak frequency bands corresponding to the common peak. Thereby, the sound signal is controlled such that the peaks appearing on the respective frequency characteristics at two listening positions are corrected.

One mode of the above sound volume control device further comprises a determining unit configured to determine whether or not the common peak is a synthesized peak formed by synthesizing a direct sound and a reflected sound, the direct sound being outputted from the speaker and reaching the listening positions without being reflected in the vehicle interior, the reflected sound being outputted from the speaker and reaching the listening positions after being reflected at a certain position in the vehicle interior, wherein, when the determining unit determines that the common peak is the synthesized peak, the control unit controls the sound signal in the peak frequency band in which the synthesized peak is appearing. In this mode, the sound signal is controlled such that the correction is made for the synthesized peak of the direct sound and the reflected sound.

In another mode of the above sound volume control device, the vehicle information comprises the sound outputted from said at least one of the pair of speakers, and the deriving unit derives the first frequency characteristic and the second frequency characteristic based on the sound. In this mode, the first and second frequency characteristics are derived by obtaining the sound outputted from the pair of speakers, and the sound signal is controlled based on the frequency characteristics.

In still another mode of the above sound volume control device, the vehicle information comprises configuration information of the vehicle interior, and the deriving unit derives the first frequency characteristic and the second frequency characteristic based on the sound signal supplied to the pair of speakers and the configuration information. In this mode, the first and second frequency characteristics are derived by using the configuration information of the vehicle interior, and the sound signal is controlled based on the frequency characteristics.

Preferably, the control unit decreases a sound volume level at the peak frequency band. Thus, the synthesized peak appearing on the frequency characteristic may be suppressed.

In a preferred example, each of the listening positions includes two evaluation points. Preferably, two evaluation points correspond to positions of left and right ears of a passenger at the listening position. In another preferred example, a center frequency of the peak frequency band is at least one of 300 Hz and 1 kHz.

According to another aspect of the present invention, there is provided a sound volume control method executed by a sound volume control device connected to a pair of speakers arranged on left and right sides of two listening positions in a vehicle interior, comprising: an obtaining process configured to obtain vehicle information; a deriving process configured to derive a first frequency characteristic and a second frequency characteristic, which are respective frequency characteristics at the two listening positions, of sound outputted from at least one of the pair of speakers based on the vehicle information; and a control process configured to control a sound signal supplied to said at least one of the pair of speakers based on the first frequency characteristic and the second frequency characteristic, wherein, when there is a common peak of the sound common to the first frequency characteristic and the second frequency characteristic, the control process controls the sound signal in at least one of peak frequency bands which are the peak frequency bands corresponding to the common peak. By this method, the sound signal is controlled such that the peaks appearing on the respective frequency characteristics at two listening positions are corrected.

According to still another aspect of the present invention, there is provided a sound volume control program executed by a sound volume control device connected to a pair of speakers arranged on left and right sides of two listening positions in a vehicle interior, the program causing the sound volume control device function as: an obtaining unit configured to obtain vehicle information; a deriving unit configured to derive a first frequency characteristic and a second frequency characteristic, which are respective frequency characteristics at the two listening positions, of sound outputted from at least one of the pair of speakers based on the vehicle information; and a control unit configured to control a sound signal supplied to said at least one of the pair of speakers based on the first frequency characteristic and the second frequency characteristic, wherein, when there is a common peak of the sound common to the first frequency characteristic and the second frequency characteristic, the control unit controls the sound signal in at least one of peak frequency bands which are the peak frequency bands corresponding to the common peak. By executing this program, the sound signal is controlled such that the peaks appearing on the respective frequency characteristics at two listening positions are corrected. This program may be handled in a manner stored in a storage medium.

Embodiments

[Basic Principle]

First, a basic principle of a sound volume control according to the embodiments will be described. While the acoustic characteristic in a vehicle interior depends on an interior configuration of the vehicle, general vehicles have similar interior configurations and speaker positions. In a general sedan-type vehicle, a driver's seat and an assistant driver's seat are arranged symmetrically as the front seats, and front speakers are mounted on left and right doors. Also, a console box is provided between the driver's seat and the assistant driver's seat. In this way, since the interior configurations and the speaker positions are similar in general vehicles, the ways that the sound reaches from the left and right speakers to the driver's seat and the assistant driver's seat are basically similar in any vehicle.

FIG. 1 shows an example of an interior configuration of a general sedan-type vehicle. Supposing that the vehicle 1 is a right-hand drive vehicle, a driver 5 sits on a driver's seat 2*d* and a passenger 6 sits on the assistant driver's seat 2*a*. A console box 3 is provided between the driver's seat 2*d* and the assistant driver's seat 2*a*. Also, a left front speaker (hereinafter referred to as "left speaker") FL is mounted on a door on the left side of the assistant driver's seat 2*a*. While a right front speaker FR is mounted on a door on the right side of the driver's seat 2*d*, the illustration thereof is omitted in FIG. 1.

In the vehicle interior configuration and the speaker position like this, when two seats of the vehicle, i.e., the driver's seat 2*d* and the assistant driver's seat 2*a* are set as listening positions and the sound reproduced by a single speaker is listened at those two seats, there is a frequency band (hereinafter simply referred to as "band") at which both of the frequency characteristics of the sound listened at those two seats have a peak in common. This is because the sound directly reaching from the speaker provided on the door to the listening position (hereinafter referred to as "direct sound") and a reflected sound by a space giving largest influence on the sound at the listening position are synthesized with (i.e., added to) each other at the listening positions of the two seats. Specifically, "the space giving largest influence on the sound at the listening position" is a space at foots of two seats (hereinafter referred to as "foot space"), but the detail of which will be described later. With respect to "the listening position", a center position of a head of a passenger sitting on the driver's seat or the assistant driver's seat is used as one evaluation point. In the following description, "the two seats" indicate the driver's seat and the assistant driver's seat.

As described above, the sound volume control device according to the embodiments determines, as the control band, the band at which both of the sound signals collected at the two seats of the vehicle has the peak, and performs attenuation control of the sound signals reproduced by the speaker at the control band. Thus, the frequency characteristics at the two seats are corrected at the same time.

[Basic Configuration]

Figure 2:
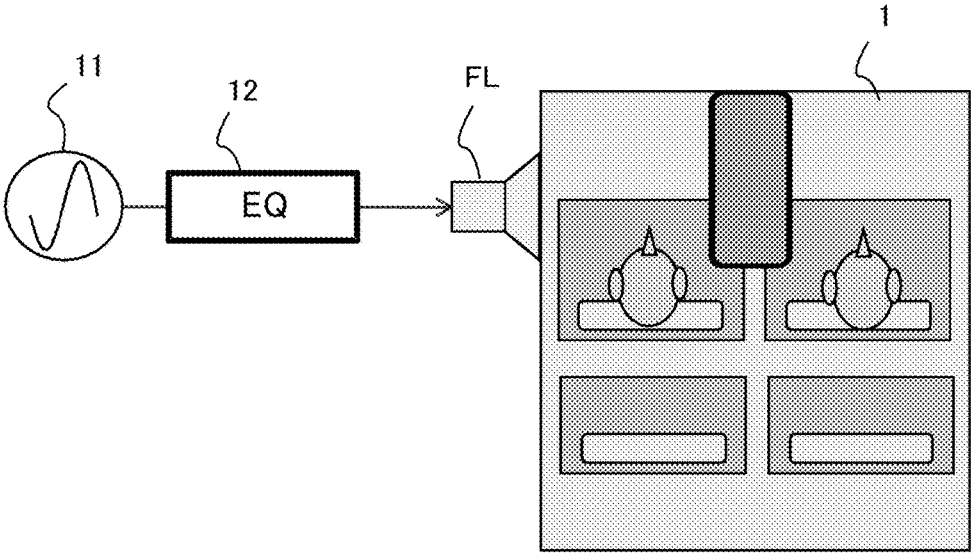
FIG. 2 illustrates a schematic configuration of a sound volume control device according to embodiments.

FIG. 2 shows a schematic configuration of the sound volume control device according to the embodiments. In the embodiments, when the sound is outputted by at least one of the speakers mounted on the front doors for the two seats of the vehicle, the attenuation control is performed at a certain control band of the sound signals supplied to the speakers. This attenuation control includes equalizer processing, gain control processing and attenuation processing.

Specifically, as shown in the example of FIG. 2, the sound signal outputted by a sound source 11 is supplied to an equalizer 12. The equalizer performs the control of attenuating the level of the sound signal in the control band, and supplies the attenuated sound signal to the left speaker FL mounted on the vehicle 1. The left speaker FL reproduces the supplied sound signal to output sound.

Thus, the sound volume control device according to the embodiments can correct the peak appearing in common in the frequency characteristics of the sound listened at the two seats, without the need of complicated calculation. While the sound is outputted only by the left speaker FL of the vehicle in the above example, the present invention is applicable to the case where the sound is outputted only by the right speaker.

[Method of Determining Control Band]

Next, description will be given of the method of determining the control band, at which the frequency characteristics of the sound signals listened at the two seats of the vehicle have the peak in common, i.e., the frequency corresponding to the peak common to the frequency characteristics of the sound signals listened at the two seat.

(1st Embodiment)

Figure 3A:
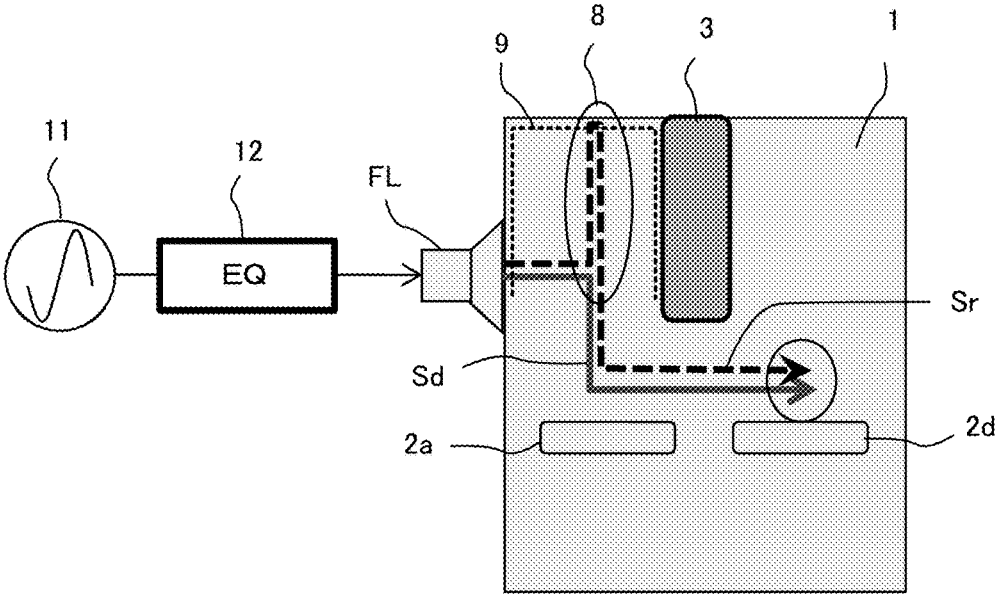
FIGS. 3A to 3C are diagrams explaining a method of determining a control band based on the configuration of the vehicle.

The first embodiment determines the control band based on the vehicle interior configuration. FIG. 3A shows an example of the vehicle interior configuration. The sound outputted by the left speaker FL reaches the driver's seat 2*d* as the direct sound Sd, and reaches the driver's seat 2*d* as the reflected sound Sr reflected by the foot space 9 formed at the foot of the assistant driver's seat 2*a*. Namely, at the driver's seat 2*d* serving as a listening position, both the direct sound Sd and the reflected sound Sr are listened.

Figure 3B:
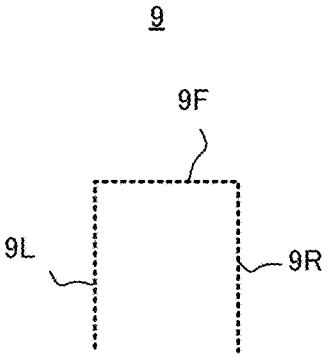

FIG. 3B schematically shows the foot space 9. The foot space 9 has a rectangular planar shape surrounded by the walls 9L, 9F and 9R from three directions. Specifically, the left side wall 9L of the foot space 9 in FIG. 3B is formed by the left side door of the vehicle 1, the front wall 9F is formed by the dashboard and its lower wall of the vehicle 1, and the right side wall 9R is formed by the side of the console box 3 on the side of the assistant driver's seat. Since such a foot space 9 is formed at the foot of the assistant driver's seat 2*a*, a part of the sound outputted by the left speaker FL is reflected in the foot space 9 and then reaches the driver's seat 2*d* as shown by the reflected sound Sr in FIG. 3A.

Since the direct sound Sd and the reflected sound Dr reach the driver's seat 2*d* serving as the listening position in this way, the direct sound Sd and the reflected sound Sr are added to each other at the frequency band at which the direct sound Sd and the reflected sound Sr are in phase with each other, thereby generating the peak in the frequency characteristics. This peak is generated by synthesizing the direct sound Sd and the reflected sound Sr at the position of the driver's seat 2*d*, and it will be hereinafter referred to as "synthesized peak". It is noted that the frequency band at which the frequency characteristic has a peak will be referred to as "peak frequency".

In FIG. 3A, supposing that the distance of the direct sound Sd reaching from the left speaker FL to the driver's seat 2*d* is Dd_d and the distance of the reflected sound Sr reaching from the left speaker FL to the driver's seat 2*d* is Dr_d, the peak frequency Fpeak_d of the synthesized peak generated in the frequency characteristic at the driver's seat 2*d* is given by the following equation. Here, "C" is a sound velocity (approximately 340 m/s).

$$Fpeak_d = C/(Dr_d - Dd_d)[\mathrm{Hz}] \quad (1)$$

On the other hand, while FIG. 3A does not show, supposing that the distance of the direct sound Sd reaching from the left speaker FL to the assistant driver's seat 2*a* is Dd_a and the distance of the reflected sound Sr reaching from the left speaker FL to the assistant driver's seat 2*a* is Dr_a, the peak frequency Fpeak_a at the assistant driver's seat 2*a* is given by the following equation.

$$Fpeak_a = C/(Dr_a - Dd_a)[\mathrm{Hz}] \quad (2)$$

Here, the distance difference (Dr_d−Dd_d) between the distance Dr_d of the reflected sound Sr and the distance Dd_d of the direct sound Sd reaching from the left speaker FL to the driver's seat 2*d* corresponds to the length of the route going to the front wall 9F and returning therefrom in the foot space 9, which is equal to the distance difference (Dr_a−Dd_a) between the distance Dr_a of the reflected sound Sr and the distance Dd_a of the direct sound Sd reaching from the left speaker FL to the assistant driver's seat 2*a*. Namely, since the following equation stands, $$(Dr_d - Dd_d) = (Dr_a - Dd_a) \quad (3)$$

the following equation is obtained:

$$Fpeak_a = Fpeak_d (= Fpeak) \quad (4)$$

Namely, the peak frequency is the same at the driver's seat 2*d* and the assistant driver's seat 2*a*. Therefore, this peak frequency Fpeak should be determined as the control band.

Figure 3C:
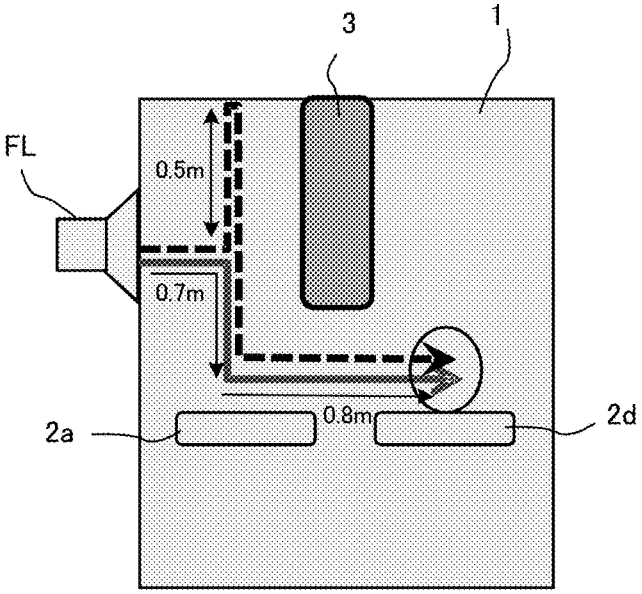

Now, in the configuration of FIG. 3A, it is supposed that the route of the direct sound Sd and the reflected sound Sr have the lengths shown in FIG. 3C. Namely, it is supposed that the distance of the sound outputted by the left speaker FL to reach the assistant driver's seat 2*a* as the direct sound Sd is 0.7 m, and the distance to further reach the driver's seat 2*d* is: 0.7+0.8=1.5 m. In addition, it is supposed that the distance of the sound outputted by the left speaker FL to be reflected in the foot space 9 is 1.0 m (go and return of 0.5 m). Then, the distance of the sound outputted by the left speaker FL to reach the assistant driver's seat 2*a* as the reflected sound Sr is: 0.5 m×2+0.4 m=1.7 m, and the distance of the sound to reach the driver's seat 2*d* is: 1.7 m+0.8 m=2.5 m.

In this case, the peak frequency is:

$$Fpeak = 340/1 = 340[\mathrm{Hz}] \quad (5)$$

Therefore, the control band is determined as the frequency band having the peak frequency 340 Hz as its center. In this example, at both of the driver's seat 2*d* and the assistant driver's seat 2*a*, the reflected sound Sr reaches 3 ms after the direct sound Sd.

Figure 4A:
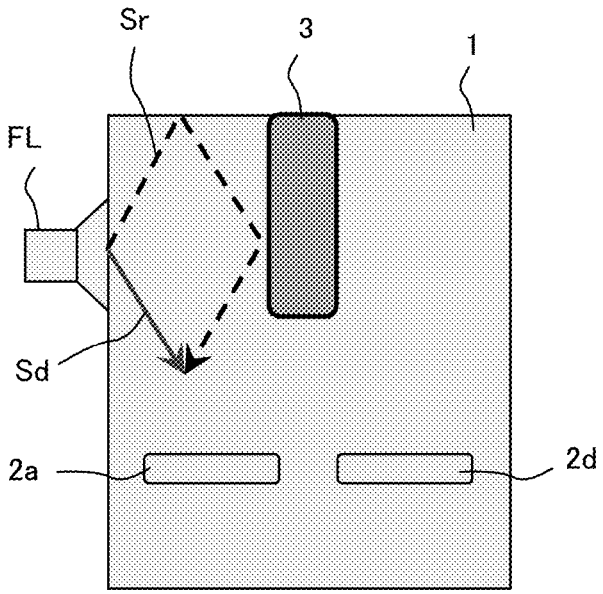
FIGS. 4A and 4B illustrate an example of calculating a peak frequency.
Figure 4B:
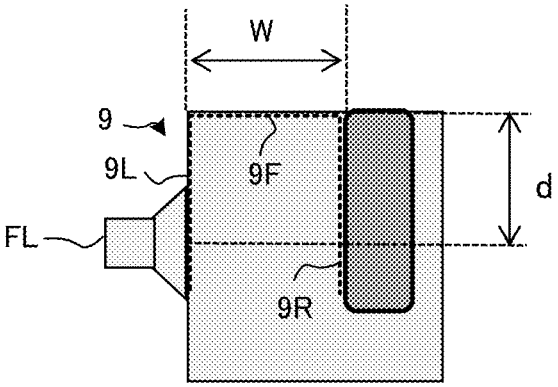

FIG. 4 shows an example of calculating the peak frequency more precisely. In the example of FIG. 3, it is supposed that the reflected sound Sr goes and returns once in the depth direction of the foot space 9 for simplicity. In this example, as shown in FIG. 4A, it is supposed that the sound outputted by the left speaker FL is reflected in a manner going around in the foot space 9 to reach the assistant driver's seat 2*a*. Specifically, as shown in FIG. 4B, it is supposed that the width of the foot space 9, i.e., the width of the front wall 9F is "w" and the distance between the front wall 9F and the left speaker FL in the front-back direction of the vehicle 1 is "d". In this case, the peak frequency is given as follows.

$$Fpeak[\mathrm{Hz}] = C(\sqrt{w^2+4d^2})^{-1} \quad (6)$$

As described above, in the first embodiment, the peak frequency of the synthesized peak of the direct sound and the reflected sound is calculated based on the vehicle interior configuration, the speaker position and the listening position, and the attenuation control is performed by the equalizer 12 using the peak frequency as the control band.

In practice, when a user inputs dimensions of the foot space to an input unit of an on-vehicle acoustic device corresponding to the volume control device, a controller such as a microcomputer in the on-vehicle acoustic device calculates the above peak frequency to determine the control band, and automatically sets the equalizer 12 to perform the attenuation control at the control band. In this case, the controller calculates the control band by executing the program prepared in advance. The equalizer 12 may be configured as a hardware device, or may be configured as software which is executed by the controller to realize the equalizer 12.

In the first embodiment, vehicle interior information is an example of the vehicle information and the configuration information of the invention, an input unit of the on-vehicle acoustic device is an example of the obtaining unit of the invention, the controller of the on-vehicle acoustic device is an example of the deriving unit of the invention, and the equalizer 12 is an example of the control unit of the invention.

(2nd Embodiment)

Figure 5:
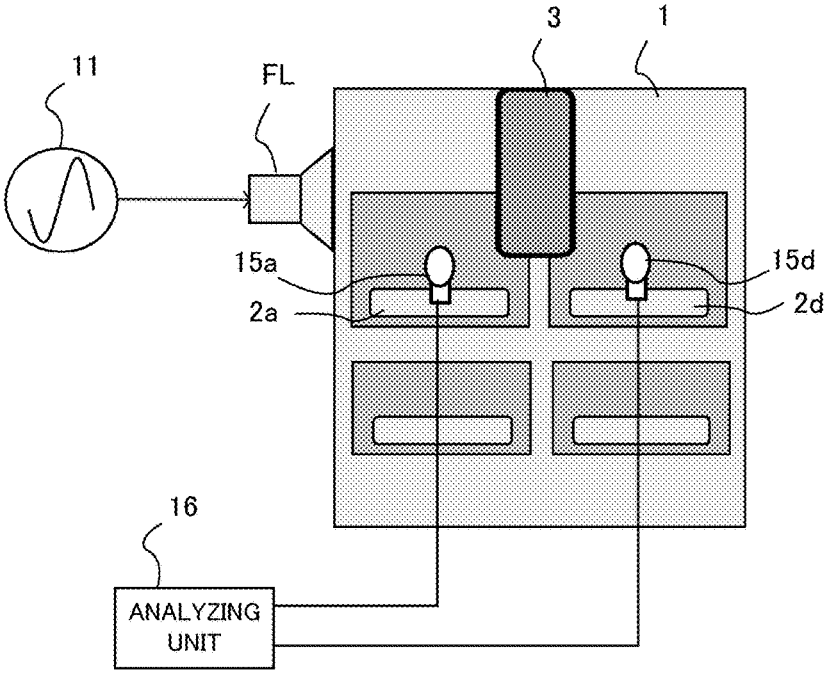
FIG. 5 is a diagram explaining a method of determining the control band based on an acoustic measurement.

The second embodiment is a method of determining the control band by an acoustic measurement in the vehicle interior. FIG. 5 shows a manner of the acoustic measurement according to the second embodiment. As the listening positions in the vehicle interior, a microphone 15*d* is arranged at the driver's seat 2*d* and a microphone 15*a* is arranged at the assistant driver's seat 2*a*. In this case, the evaluation points, i.e., the positions where the microphones 15*d*, 15*a* are arranged, are the center positions of the heads of the passengers seated at the driver's seat 2*d* and the assistant driver's seat 2*a*. In the acoustic measurement, a test signal is outputted by a sound source 11, and the left speaker FL outputs the test sound which is collected by the microphones 15*d*, 15*a*. The sound signals collected by the microphones 15*d*, 15*a* are supplied to an analyzing unit 16.

Instead of arranging the microphones 15*d*, 15*a* at the center positions of the heads of the passengers as the evaluation points, a dummy heads may be arranged at each of the driver's seat 2*d* and the assistant driver's seat 2*d* to output a sum of the outputs of two microphones provided at the position of both ears of the dummy head (i.e., a both-ear level sum) to the analyzing unit 16. In this case, the listening position includes two evaluation points corresponding to the positions of left and right ears of the dummy head.

The analyzing unit 16 calculates a transfer function from the left speaker FL to the driver's seat 2*d* and a transfer function from the left speaker FL to the assistant driver's seat 2*d* based on the sound signals from the microphones 15*d*, 15*a*, and derives frequency characteristics at the driver's seat 2*d* and the assistant driver's seat 2*a*. Then, the analyzing unit 16 determines the peak frequency of the synthesized peak based on the frequency characteristics at the driver's seat 2*d* and the assistant driver's seat 2*a*, and set the control band having the peak frequency as the center frequency.

Figure 6A:
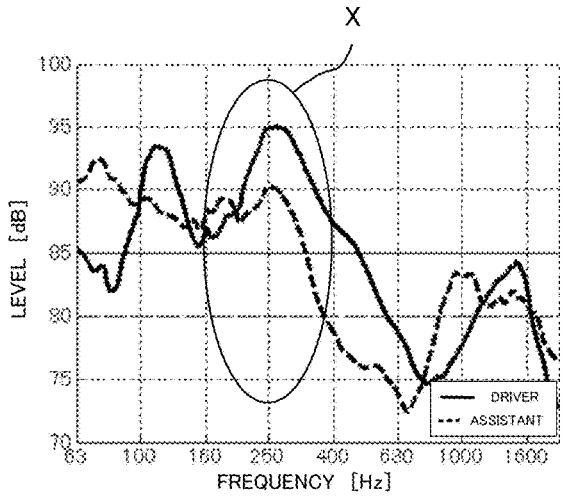
FIGS. 6A to 6C illustrate frequency characteristics in a case where an attenuation control is performed in the control band determined based on the acoustic measurement.
Figure 6B:
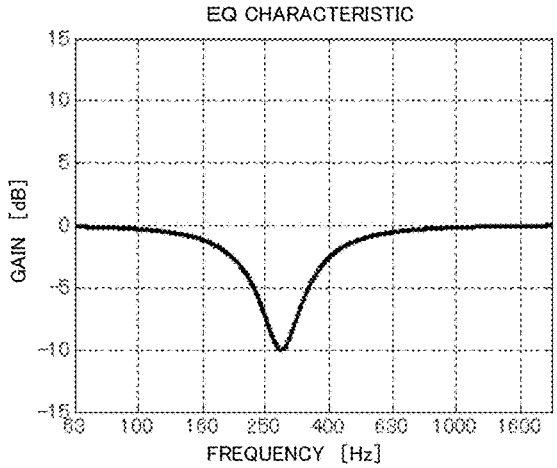
Figure 6C:
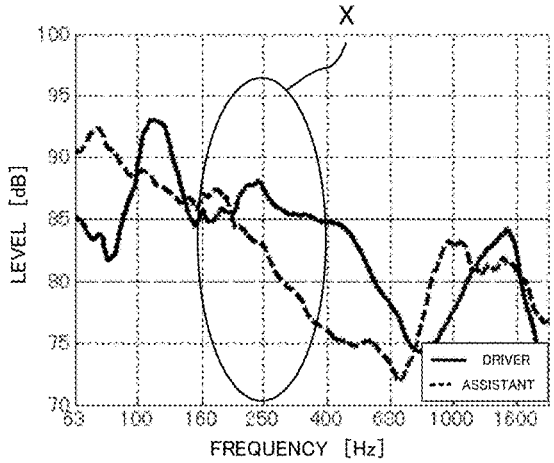

FIGS. 6A to 6C show examples of the frequency characteristics at the driver's seat 2*d* and the assistant driver's seat 2*a*. FIG. 6A shows examples of the frequency characteristics obtained by the analyzing unit 16, wherein the solid line indicates the frequency characteristic at the driver's seat 2*d* and the broken line indicates the frequency characteristic at the assistant driver's seat 2*a*. In the examples of FIG. 6A, since the synthesized peak appears around 300 Hz as shown by the ellipse X, this peak frequency should be set to the center frequency of the control band.

FIG. 6B shows an attenuation characteristic of the equalizer 12 attenuating the sound volume level at the control band around the peak frequency 300 Hz. FIG. 6C shows the frequency characteristics at the driver's seat 2*d* and the assistant driver's seat 2*a* when the sound signal attenuated by the equalizer 12 having the attenuation characteristic shown in FIG. 6B is reproduced by the left speaker FL. As it is understood in comparison with FIG. 6A, the synthesized peak around 300 Hz is suppressed.

As described above, in the second embodiment, since the control band is determined by measuring the actual acoustic characteristic in the vehicle interior, the control band can be accurately determined for the vehicle of respective type.

In the second embodiment, the microphones 15*d*, 15*a* are examples of the obtaining unit of the present invention, the analyzing unit 16 is an example of the deriving unit of the present invention, and the equalizer 12 is an example of the control unit of the present invention.

[Control by Left and Right Speakers]

Figure 7:
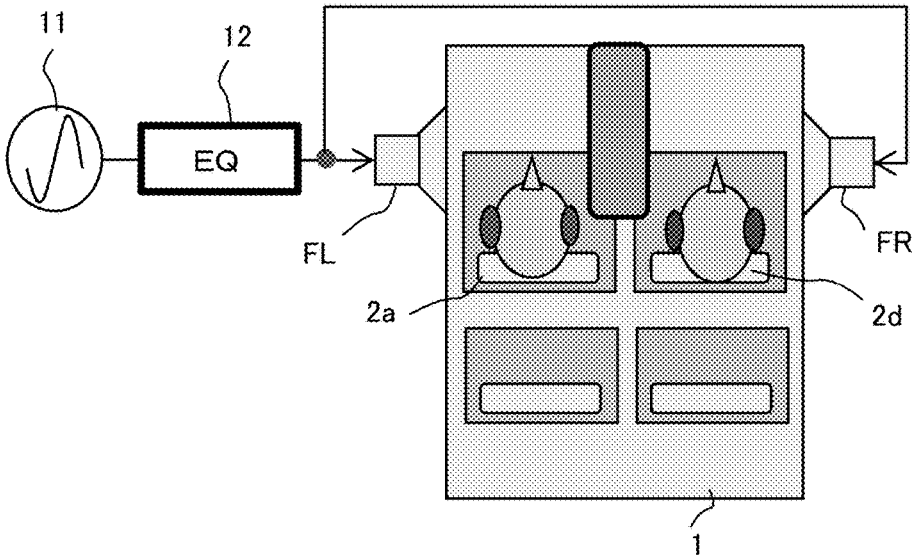
FIG. 7 illustrates a configuration of a sound volume control device which reproduces sound from left and right speakers.

While the sound is outputted only from the left speaker FL in the above-described example, the present invention is applicable to the case where sound is outputted from left and right speakers. FIG. 7 shows a configuration in which the signal is inputted to a left front speaker FL and a right front speaker FR. Specifically, the sound signal outputted from the sound source 11 is inputted to the equalizer 12, and the equalizer 12 supplies the sound signals, whose level in the control band is attenuated, to the left and right speakers FL, FR.

As described above, the configuration of the vehicle interior is such that the driver's seat 2*d* and the assistant driver's seat 2*a* are symmetrically arranged, the left and right front speakers FL, FR are arranged at symmetrical positions, and the console box 3 exists on the symmetrical axis. Thus, the relation of the left speaker FL with respect to the driver's seat 2*d* and the assistant driver's seat 2*a* is the same as the relation of the right speaker FR with respect to the assistant driver's seat 2*a* and the driver's seat 2*d*. Therefore, even if the sound is outputted from the left and right speakers FL, FR, the synthesized peak in the frequency characteristics at the driver's seat 2*d* and the assistant driver's seat 2*a* can be suppressed at the same time by attenuating the sound volume level of the control band by a single equalizer. The description will be given of the cases of the stereo signal and the monaural signal.

(In Case of Stereo Signal)

In the case of stereo signal, uncorrelated signals are inputted to the left and right front speakers FL, FR. However, since the relation of the left speaker FL with respect to the driver's seat 2*d* and the assistant driver's seat 2*a* is the same as the relation of the right speaker FR with respect to the assistant driver's seat 2*a* and the driver's seat 2*d* as described above, the peak frequency for the sound outputted from the left speaker FL at the driver's seat 2*d* and the assistant driver's seat 2*a* is the same as the peak frequency for the sound outputted from the right speaker FR at the assistant driver's seat 2*a* and the driver's seat 2*d*. Therefore, by performing the attenuation control at the peak frequency band by a single equalizer, the peaks of the sounds outputted from two speakers FL, FR can be suppressed at the same time.

Figure 8A:
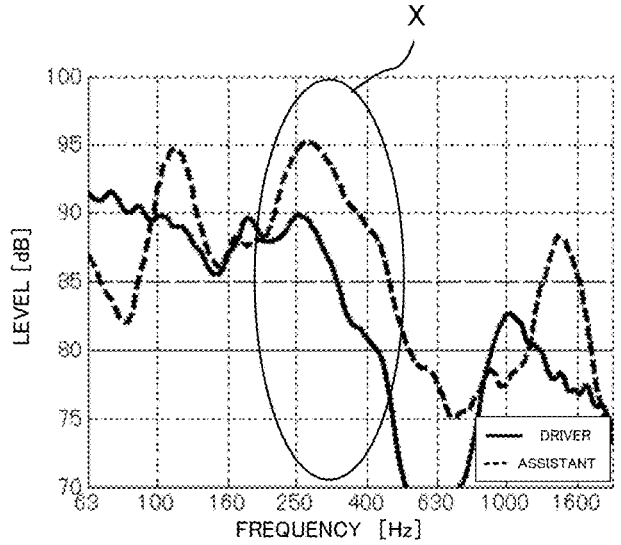
FIGS. 8A to 8C illustrate frequency characteristics in a case where a stereo signal is inputted to the left and right speakers.
Figure 8B:
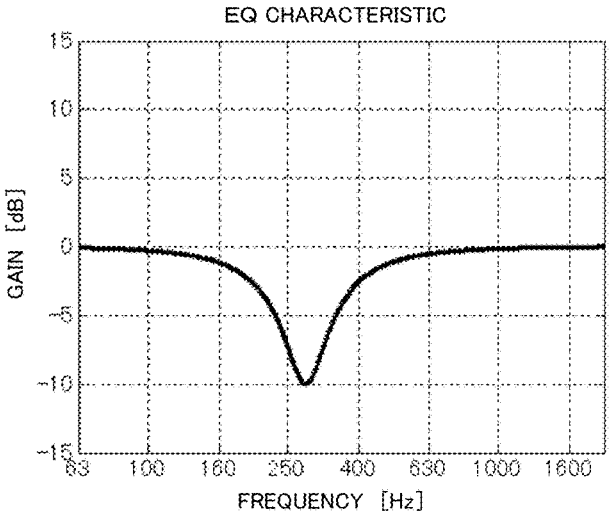
Figure 8C:
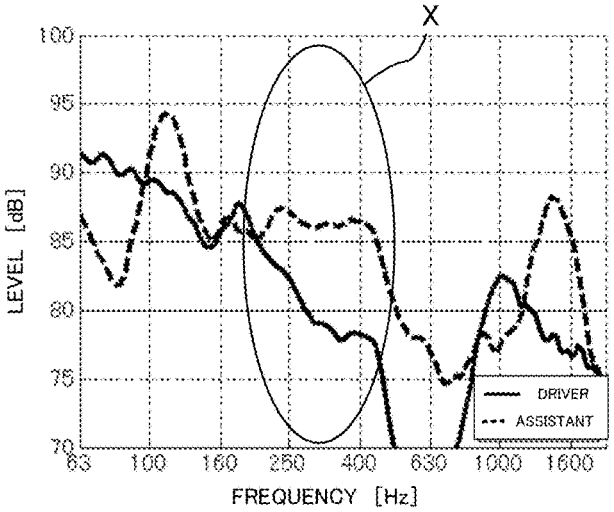

FIGS. 8A to 8C show frequency characteristics in a case where the stereo signal is inputted to the left and right speakers FL, FR in the configuration of FIG. 7. FIG. 8A shows the frequency characteristics at the driver's seat 2*d* and the assistant driver's seat 2*a*. As shown by the ellipse X, the synthesized peak appears around 300 Hz. Thus, the peak frequency 300 Hz is determined as the center frequency of the control band, and the attenuation characteristic shown in FIG. 8B is set to the equalizer 12. Thus, the frequency characteristics shown in FIG. 8C are obtained at the driver's seat 2*d* and the assistant driver's seat 2*a*. As it is understood from FIG. 8C, the synthesized peak around 300 Hz is suppressed.

(In Case of Monaural Signal)

In the case of monaural signal, the same signal is inputted to the left and right speakers FL, FR. As described above, the relation of the left speaker FL with respect to the driver's seat 2*d* and the assistant driver's seat 2*a* is the same as the relation of the right speaker FR with respect to the assistant driver's seat 2*a* and the driver's seat 2*d*. Therefore, even if the monaural signal is inputted to the left and right speakers FL, FR, similarly to the case where the sound signal is inputted only to one of those speakers, the peaks of the sounds outputted from two speakers FL, FR can be suppressed at the same time by performing the attenuation control at the peak frequency band by a single equalizer.

Figure 9A:
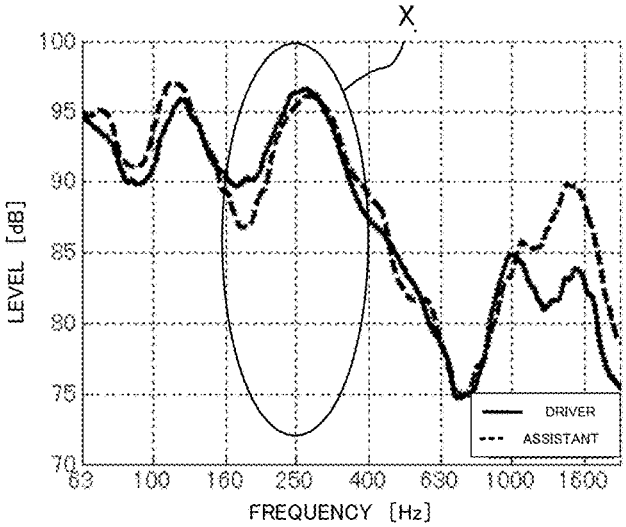
FIGS. 9A to 9C illustrate frequency characteristics in a case where a monaural signal is inputted to the left and right speakers.
Figure 9B:
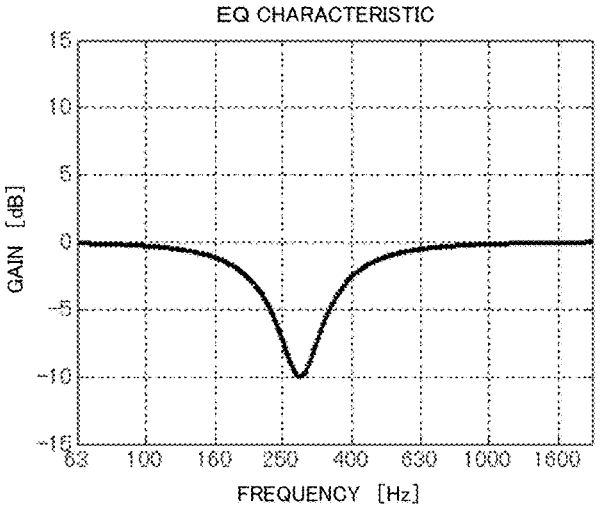
Figure 9C:
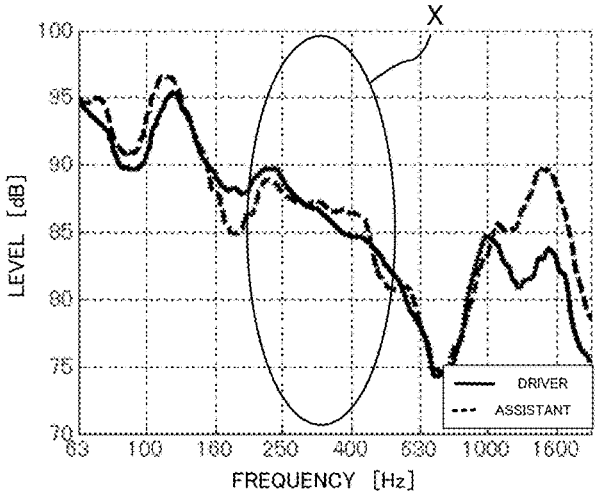

FIGS. 9A to 9C show frequency characteristics in a case where the monaural signal, i.e., the same signal is inputted to the left and right speakers FL, FR in the configuration of FIG. 7. FIG. 9A shows the frequency characteristics at the driver's seat 2*d* and the assistant driver's seat 2*a*. As shown by the ellipse X, the synthesized peak appears around 300 Hz. Thus, the peak frequency 300 Hz is determined as the center frequency of the control band, and the attenuation characteristic shown in FIG. 9B is set to the equalizer 12. Thereby, the frequency characteristics shown in FIG. 9C are obtained at the driver's seat 2*d* and the assistant driver's seat 2*a*. As it is understood from FIG. 9C, the synthesized peak around 300 Hz is suppressed.

[Effect of Embodiments]

Figure 10:
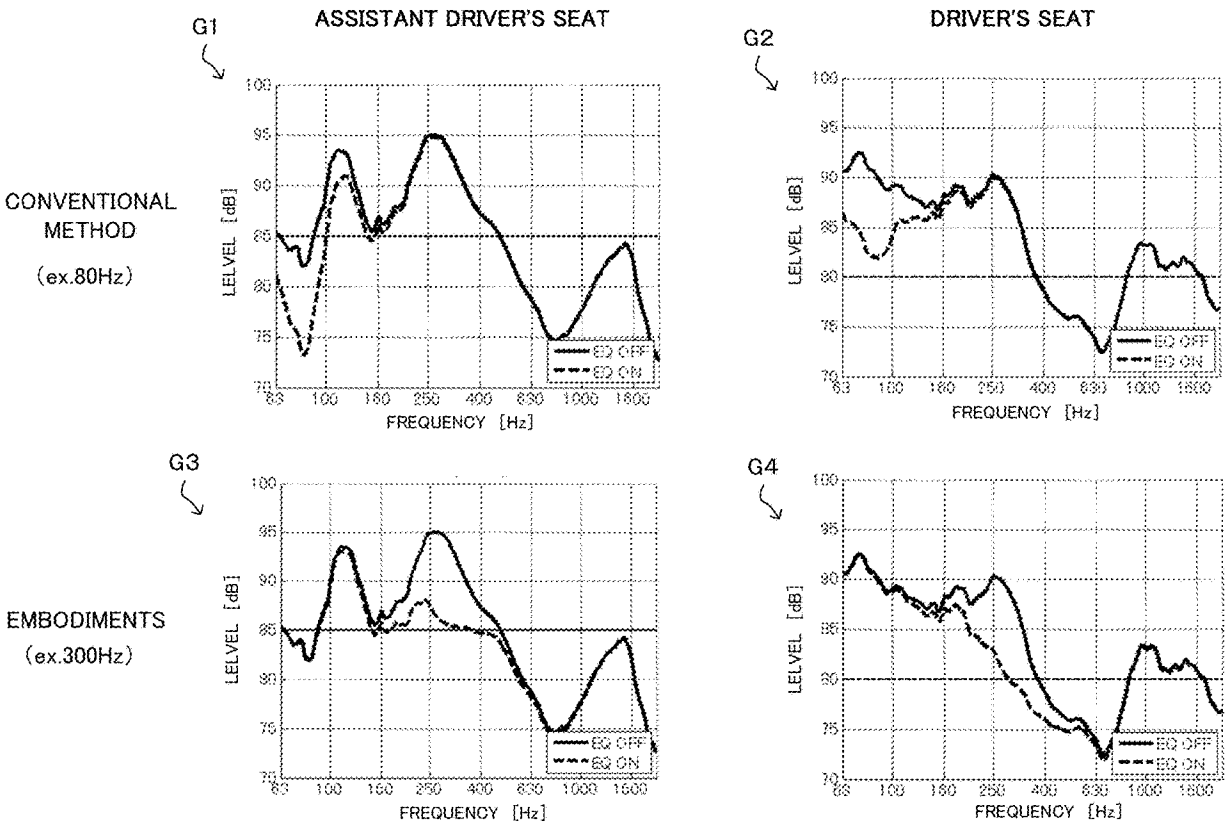
FIG. 10 illustrates graphs indicating effects of a conventional method and a method of the embodiments.

FIG. 10 shows frequency characteristics by the method of the embodiment and the conventional method. The graphs G1, G2 show the frequency characteristics by the conventional method, and the graphs G2, G4 show the frequency characteristics by the method of the embodiments. It is noted that the conventional method means the processing of attenuating a certain peak in the frequency characteristic at the driver's seat by the methods of the above-mentioned Patent References 1 to 4. In the graphs G1 to G4, the solid lines (EQ OFF) indicate the frequency characteristic before the attenuation control and the broken lines (EQ ON) indicate the frequency characteristics after the attenuation control.

In the conventional method, as shown by the graph G2, there is a peak around 80 Hz in the frequency characteristic at the driver's seat before the correction (solid line). In this view, if the correction is made to attenuate the band having the center frequency 80 Hz according to the conventional method, the peak around 80 Hz is suppressed as shown by the frequency characteristic shown by the broken line. However, since there is a small dip around 80 Hz in the frequency characteristic at the assistant driver's seat before the correction (solid line) as shown in the graph G1, if the band having the center frequency 80 Hz is attenuated, the dip around 80 Hz becomes larger in the frequency characteristic at the assistant driver's seat. Namely, it is not possible to improve the frequency characteristics at both the driver's seat and the assistant driver's seat.

In contrast, according to the method of the embodiments, the center frequency of the control band is determined to be around 300 Hz, where both the frequency characteristics at the driver's seat and the assistant driver's seat before correction (solid lines) have the peak as shown by the graphs G3, G4, and the attenuation control is performed at the control band. Therefore, as shown by the broke lines in the graphs G3, G4, the peak can be suppressed at both the driver's seat and the assistant driver's seat in the frequency characteristics after the correction.

[Other Control Band]

Figure 11A:
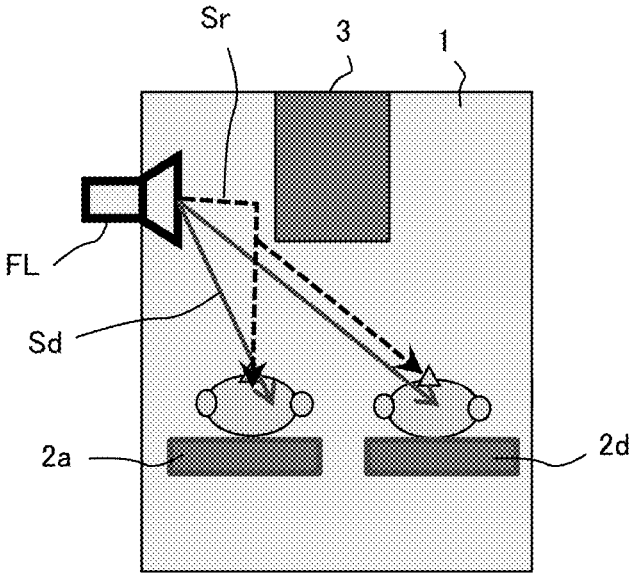
FIGS. 11A and 11B illustrate an example of another control band.

In the above embodiments, it is determined based on the configuration of a general vehicle that the synthesized peak appears around 300 Hz. Further, there is a possibility that another synthesized peak appears around 1 kHz. FIG. 11A shows the routes of the direct sound Sd and the reflected sound Sr when the synthesized peak appears around 1 kHz. The synthesized peak appears around 300 Hz when the reflected sound Sr is reflected by the front wall 9F in the foot space 9 as shown in FIG. 3A. On the other hand, apart of the sound outputted from the left speaker FL is reflected by the console box 3 to reach the driver's seat 2*d* and the assistant driver's seat 2*a* as the reflected sound Sr as shown in FIG. 11A. In this case, supposing a general vehicle supposed in the example of FIG. 3A, the distance Dd of the direct sound Sd from the left speaker FL to the assistant driver's seat 2*a* is approximately 1 m, and the distance Dr of the reflected sound Sr outputted from the left speaker FL and reflected by the console box 3 to reach the assistant driver's seat 2*a* is approximately 1.3 m. Therefore, the peak frequency is:

$$F\text{peak}=C/(Dr-Dd)=\text{approximately 1000 Hz} \quad (7)$$

Figure 11B:
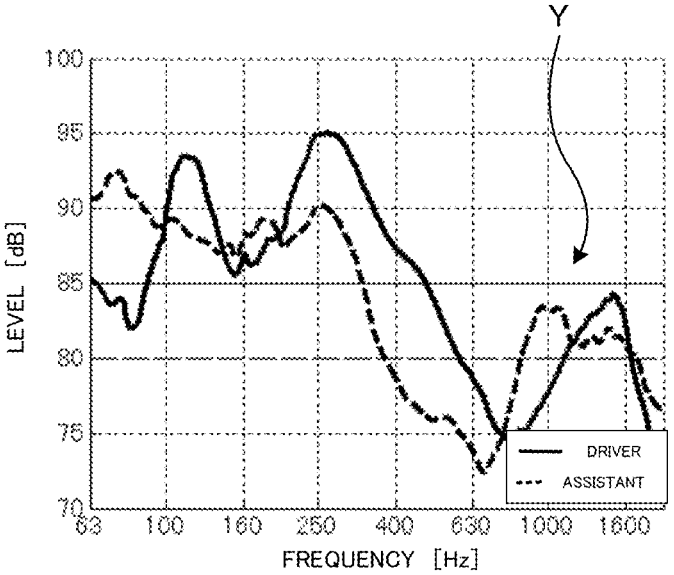

Therefore, as shown by the arrow Y in FIG. 11B, the synthesized peak appears around 1 kHz. In this case, the synthesized peak can be suppressed by setting the center frequency of the control band to 1 kHz and performing the attenuation control by the equalizer 12.

INDUSTRIAL APPLICABILITY

This invention can be used for a sound reproduction apparatus loaded on a vehicle.

BRIEF DESCRIPTION OF REFERENCE NUMBERS

1 Vehicle
2*a* Assistant Driver's Seat
2*d* Driver's Seat
3 Console Box
9 Foot Space
11 Sound Source
12 Equalizer
15*a*, 15*d* Microphone

The invention claimed is:

1. A sound volume control device connected to a pair of speakers arranged on left and right sides of two listening positions in a vehicle interior, comprising:

an analyzer configured to derive a first frequency characteristic and a second frequency characteristic, each of which is a frequency characteristic at one of the two listening positions, of sound outputted from at least one of the pair of speakers; and a controller configured to control a sound signal of at least one of peak frequency bands of the sound common to the first frequency characteristic and the second frequency characteristic.

2. The sound volume control device according to claim 1, wherein the peak frequency band of the sound common to the first frequency characteristic and the second frequency characteristic is formed by synthesizing a direct sound and a reflected sound, the direct sound being outputted from the speaker and reaching the listening positions without being reflected in the vehicle interior, the reflected sound being outputted from the speaker and reaching the listening positions after being reflected at a certain position in the vehicle interior.

3. The sound volume control device according to claim 1, wherein the controller decreases a sound volume level at the peak frequency band.

4. The sound volume control device according to claim 1, wherein each of the listening positions includes two evaluation points.

5. The sound volume control device according to claim 1, wherein a center frequency of the peak frequency band is at least one of 300 Hz and 1 kHz.

6. The sound volume control device according to claim 1, further comprising an input device to which vehicle information is inputted, wherein the analyzer derives the first frequency characteristic and the second frequency characteristic based on the vehicle information.

7. The sound volume control device according to claim 6, wherein the vehicle information comprises the sound outputted from at least one of the pair of speakers, and wherein the analyzer derives the first frequency characteristic and the second frequency characteristic based on the sound.

8. The sound volume control device according to claim 6, wherein the vehicle information comprises configuration information of the vehicle interior, and wherein the controller calculates the peak frequency bands based on the configuration information.

9. A sound volume control method executed by a sound volume control device connected to a pair of speakers arranged on left and right sides of two listening positions in a vehicle interior, comprising:

a deriving process configured to derive a first frequency characteristic and a second frequency characteristic, each of which is a frequency characteristic at one of the two listening positions, of sound outputted from at least one of the pair of speakers; and a control process configured to control a sound signal of at least one of peak frequency bands of the sound common to the first frequency characteristic and the second frequency characteristic.

10. A non-transitory computer-readable medium storing a sound volume control program executed by a sound volume control device connected to a pair of speakers arranged on left and right sides of two listening positions in a vehicle interior, the program causing the sound volume control device function as:

a deriving unit configured to derive a first frequency characteristic and a second frequency characteristic, each of which is a frequency characteristic at one of the two listening positions, of sound outputted from at least one of the pair of speakers; and a control unit configured to control a sound signal of at least one of peak frequency bands of the sound common to the first frequency characteristic and the second frequency characteristic.

* * * * *